US009123238B1

(12) United States Patent
Smith

(10) Patent No.: US 9,123,238 B1
(45) Date of Patent: Sep. 1, 2015

(54) METHOD TO ENABLE SMALL VEHICLES TO TRIP A TRAFFIC LIGHT INDUCTIVE LOOP SENSOR

(71) Applicant: Michael Gordon Smith, Minnetonka, MN (US)

(72) Inventor: Michael Gordon Smith, Minnetonka, MN (US)

( * ) Notice: Subject to any disclaimer, the term of this patent is extended or adjusted under 35 U.S.C. 154(b) by 0 days.

(21) Appl. No.: 14/277,020

(22) Filed: May 13, 2014

Related U.S. Application Data

(60) Provisional application No. 61/824,954, filed on May 17, 2013.

(51) Int. Cl.
*G08G 1/01* (2006.01)
*G08G 1/042* (2006.01)
*G08G 1/07* (2006.01)

(52) U.S. Cl.
CPC . *G08G 1/042* (2013.01); *G08G 1/07* (2013.01)

(58) Field of Classification Search
CPC ..... G08G 1/042; G08G 1/07
USPC ..... 340/941, 933; 702/182
See application file for complete search history.

(56) References Cited

U.S. PATENT DOCUMENTS

| | | | | |
|---|---|---|---|---|
| 4,529,982 | A * | 7/1985 | Karlstrom et al. | 340/991 |
| 4,566,008 | A * | 1/1986 | Powers et al. | 340/941 |
| 5,057,831 | A | 10/1991 | Strang | |
| 5,652,577 | A | 7/1997 | Frasier | |
| 6,072,408 | A | 6/2000 | Baer | |
| 6,075,466 | A * | 6/2000 | Cohen et al. | 340/933 |
| 6,137,424 | A * | 10/2000 | Cohen et al. | 340/933 |
| 6,876,949 | B2 * | 4/2005 | Hilliard et al. | 702/182 |
| 7,432,827 | B2 | 10/2008 | Richley | |
| 7,907,065 | B2 | 3/2011 | Richley | |
| 8,212,690 | B1 * | 7/2012 | Partin | 340/941 |

* cited by examiner

*Primary Examiner* — Albert Wong

(57) ABSTRACT

A method to allow vehicles of low metallic mass to trip an inductive loop detector at a traffic light by first matching the loop detector's running frequency, then, while monitoring, raising the frequency of the loop detector through normal transformer action with a transducer that is in close proximity to the loop detector, until the frequency of the transmissions from the transducer and that of the loop detector just start to diverge. This is the point at which maximal influence is achieved over the loop detector's running frequency commensurate with the transformer couple that exists between transducer and loop detector. Since the initially encountered (uninfluenced) frequency of the loop detector is measured, and the degree of increase subsequently induced is known in real time, a display can be provided for the user showing not only that a loop has been detected, but also the degree of influence achieved.

14 Claims, 4 Drawing Sheets

METHOD TO ENABLE SMALL VEHICLES TO TRIP A TRAFFIC LIGHT INDUCTIVE LOOP SENSOR

RELATED US APPLICATIONS

This application claims the benefit of PPA No. 61/824,954 filed 2013 May 17 by the present inventor.

FIELD OF INVENTION

One of the most common forms of vehicle detector currently in use at a traffic light is the inductive loop detector, a buried loop of wire sometimes visible as a 4 to 6 foot square or rectangular mark in the road surface. They are commonly found at a left turn lane of a traffic junction in the USA. Smaller vehicles such as a motorcycle do not always have enough metallic mass to affect the inductive loop detector and the smaller vehicle is not detected and the operator misses their rightful turn. This is a very common problem, as experienced by the inventor. The invention is a device whose purpose is to make a small vehicle such as a motorcycle, or even a bicycle, more "visible" (detectable) to a traffic light that uses an inductive loop detector.

PRIOR ART

To understand the prior art, it is first necessary to understand how a traffic light inductive loop detector works. This type of detector uses a coil of wire (loop) buried into the road surface typically in the first position where vehicles stop and wait for the traffic light to change. This coil may consist of three or four turns of wire—typically a 4 to 6 feet rectangle—installed 2 or 3 inches below the road surface, and is one component part of a resonant oscillator circuit. The rest of the oscillator circuit, to which the loop is connected, is built into a loop detector box or printed circuit card which is in turn located in a traffic light control box. This latter box is usually physically located at one corner of the traffic junction that is controlled by the traffic light, and contains loop detectors for all the loops at that junction, as well as the traffic light system controller itself. When a conductive object such as the metal of a car is positioned over the area of the wire loop in the road surface, the magnetic field generated by the alternating current flowing in the wire loop induces small electrical currents in the conductive object. These currents generate their own magnetic fields that oppose the field generated in the wire loop. This causes the inductance of the wire loop to be reduced slightly, thus slightly increasing the resonant frequency of the detector's oscillator. This small frequency change is interpreted by the loop detector as vehicle "presence" and is passed on to the traffic light system controller to control the traffic lights. Note that, since this is a resonant circuit, the physical size and shape of the wire loop, together with the number of turns of wire therein, have a large effect on the actual frequency each individual loop detector runs at and no two are exactly the same. In addition, there are also selections of complimentary resonant components in the loop detector chosen by the traffic light technician when setting up the system. These selections enable the technician to select different frequencies to avoid cross-talk between adjacent loop detectors. Thus loop detectors have widely varying and unpredictable running frequencies.

However, some smaller vehicles may not have sufficient metallic mass to influence, and therefore trigger, the loop detector and the vehicle's operator may miss their rightful turn at the traffic light. So to assist in such situations, several methods have been tried to trigger the inductive loop detector with varying degrees of success and practicality. One of the first the inventor tried is to use a large conductive sheet held parallel to the ground and inductive loop. It was found that a sheet of aluminum foil as small as 2 feet square (4 square feet) was enough to trigger a perfectly functioning loop detector. However, this is hardly practical and as small a surface area as it was, it was still too big and awkward to carry around and then hold out over the road surface. If this same foil sheet was folded, it lost its ability to influence the loop detector in proportion to the surface area lost by folding. So it's not just a certain mass of metal that is required to trigger the loop detector. It must offer some minimum surface area parallel to that detector to be effective. The inventor found also that the effect was quite small even with a perfectly tuned and sensitive loop detector, and would be ineffective against the sort of insensitive loop detector this patent is intended to address; the sort that a small vehicle such as a motorcycle has problems triggering. Note that a method similar to this was described in Frasier (U.S. Pat. No. 5,652,577).

Some prior art has used the transmission of a large frequency sweep to find that of the loop detector; to either hopefully momentarily affect the loop and cause a vehicle "detection" (Baer and Sunda: U.S. Pat. No. 6,072,408, first embodiment), or to use the beat frequency of the sweeping transmitter with the frequency of the loop detector (heterodyning) to lock on to the loop detector (Richley: U.S. Pat. Nos. 7,432,827 and 7,907,065). Both methods have the disadvantage of having to transmit a sweep through every possible frequency (say 100 k down to 10 k) in order to find the correct one, risking interference with any nearby device as a large frequency sweep has the potential to do. The former also relies on and assumes that a momentary detection is latched. With modern loop detectors, this is not generally the case.

The second embodiment of Baer and Sunda (U.S. Pat. No. 6,072,408) turns off periodically to examine the loop detector's frequency in an attempt to match the frequency of the loop detector. However, many modern loop detectors drive more than one loop and multiplex between them one at a time. Thus, much of the time, any one loop in this scheme is not driven and there is no signal to detect. For example, at a junction with 4 loops, any one loop may only be driven one quarter of the time. Thus this method would somehow have to know when to turn off transmissions in order to examine that of the loop it is placed in close proximity to. No such mechanism is shown in U.S. Pat. No. 6,072,408. As no two loop detectors are exactly alike, this scheme does not lend itself to working with modern traffic light loop detectors. Moreover, in an attempt to cause a trigger of the loop detector, transmissions in U.S. Pat. No. 6,072,408 are varied by amounts as high as 10%. This is way beyond the normal trigger range of most modern loop detectors which tend to trigger with changes in frequency of less than one percent of running frequency. It is highly unlikely that an inductive couple could be achieved between a transducer and the detector loop buried in the road that could pull (influence) the running frequency anywhere near 10%, especially with a troublesome insensitive detector the likes of which this patent covers. Even if such a large pull could be achieved, the loop detector could be faulted out (detect and latch an error condition) since modern detectors have analytical circuitry that monitors unusual behavior of the loop in order to detect circuitry failure. Such a large frequency shift risks a fault being latched in such circuitry and putting the detector in need of maintenance. This would quickly make these devices very unpopular with traffic light technicians and the authorities that employ them.

Expired patent prior art Strang et al (U.S. Pat. No. 5,057,831) discusses a method of measuring the loop detector frequency before trying to influence it, thus avoiding the potential problems of a large frequency sweep. It mentions that it will simulate the influence of a detectable vehicle by re-radiating the received signal. However, it does not indicate how doing so would in fact influence the loop detector. At one point, U.S. Pat. No. 5,057,831 mentions influencing the loop detector by re-radiating at a lower frequency. This is incorrect. Most modern loop detectors are designed to consider a drop in frequency as a new steady state condition; an environmental change to which it should adapt, perhaps caused by an abrupt change in weather conditions. No trigger will occur by lowering the frequency. However, the subsequent rise in frequency when the influence of U.S. Pat. No. 5,057,831 is removed from the vicinity of the loop detector may then be considered a trigger (assuming the device was effective enough to create such a change) and ironically, the loop detector will "detect" a vehicle's presence after U.S. Pat. No. 5,057,831 leaves the area of the loop. Moreover, this "presence" will persist since the new increase will not change since it is in reality the real steady state condition. Thus the loop detector is compromised and again may require a technician's attention. Another related inaccuracy mentioned is that the presence of a large metallic mass in the vicinity of the loop detector will lower the resonant frequency of same. This is again incorrect. As discussed above in the opening paragraph of the Prior Art section, the currents induced in the metallic mass set up an opposing magnetic field that reduces the effective inductance of the loop thus increasing the resonant frequency of the loop detector. Another shortcoming of U.S. Pat. No. 5,057,831 is that it has no way of detecting when it has achieved an optimal frequency change commensurate with the current influence the device has over the loop detector (inductive couple). It is basically blindly trying to influence the loop detector. It may attempt to pull the frequency too far or not far enough for the couple it can achieve with the loop detector and end up with little or no effect.

SUMMARY OF INVENTION

In accordance with one embodiment, this invention first measures the loop detector's running frequency, then transmits a matching signal while continuing to monitor both the transmission signal and loop detector. By normal transformer coupling, the device couples with the loop detector and then raises the transmission frequency slightly until it detects more than one signal. That is, the transmissions and loop detector signals start to separate and diverge. This indicates the precise frequency that the achieved couple between device and loop detector can maximally support. Any further raising of the frequency would result in a larger divergence of transmitter and loop detector as the latter's running frequency drops back to normal. Thus nominal influence over the present couple is measured and achieved for every loop detector regardless of its running frequency or sensitivity, or the placement of the device relative to the loop detector.

This method has several advantages over the prior art. It does not sweep through all possible frequencies to find that of the currently affected loop detector. It runs only at the exact same frequency that the loop detector itself runs at, thus avoiding possible interference with nearby equipment. It automatically finds the best possible level of influence over the loop detector commensurate with the level of couple achieved with it. The latter will be different every time as it is highly unlikely that the vehicle will park exactly in the same location and orientation each time a particular loop detector is approached.

Because the level of couple and running frequency are measured and therefore known at influence time, the percentage of frequency change achieved is also known and can be displayed, showing the user the affect the device is having on the loop detector, or that it is even detected at all. This has two advantages: one is that the user can be assured that he/she is influencing the loop detector and that they have been detected by it, and two: it may avoid confusion over junctions that do not use loop detectors, but instead use a different technology such as optical traffic detection. One learns to recognize these different types of junctions as they have visible clues such as cameras mounted above the junction opposite each intersection for the optical detection type. But an indication on a possible device display would be helpful in confirming that they are indeed parked over a loop detector.

DESCRIPTION OF FIRST EMBODIMENT

The embodiment of the device described mimics the influence a large conductive mass has over a loop detector. Instead of affecting the loop detector oscillator's resonant frequency by changing the inductance of the wire loop with a nearby large conductive mass such as a car, the device inductively couples with the loop by matching its resonant frequency and then, through normal transformer action, "pulls" that frequency slightly higher sufficient to be detected and interpreted as vehicle presence by the loop detector. The degree of influence, or "pull" that can be achieved is greatly influenced by the degree of transformer "couple" achievable between the detector loop and the device's own output transducer. In tests using a modern loop detector, a "pull" equivalent to the mass of a large car positioned over the loop has been achieved.

Figure 1:
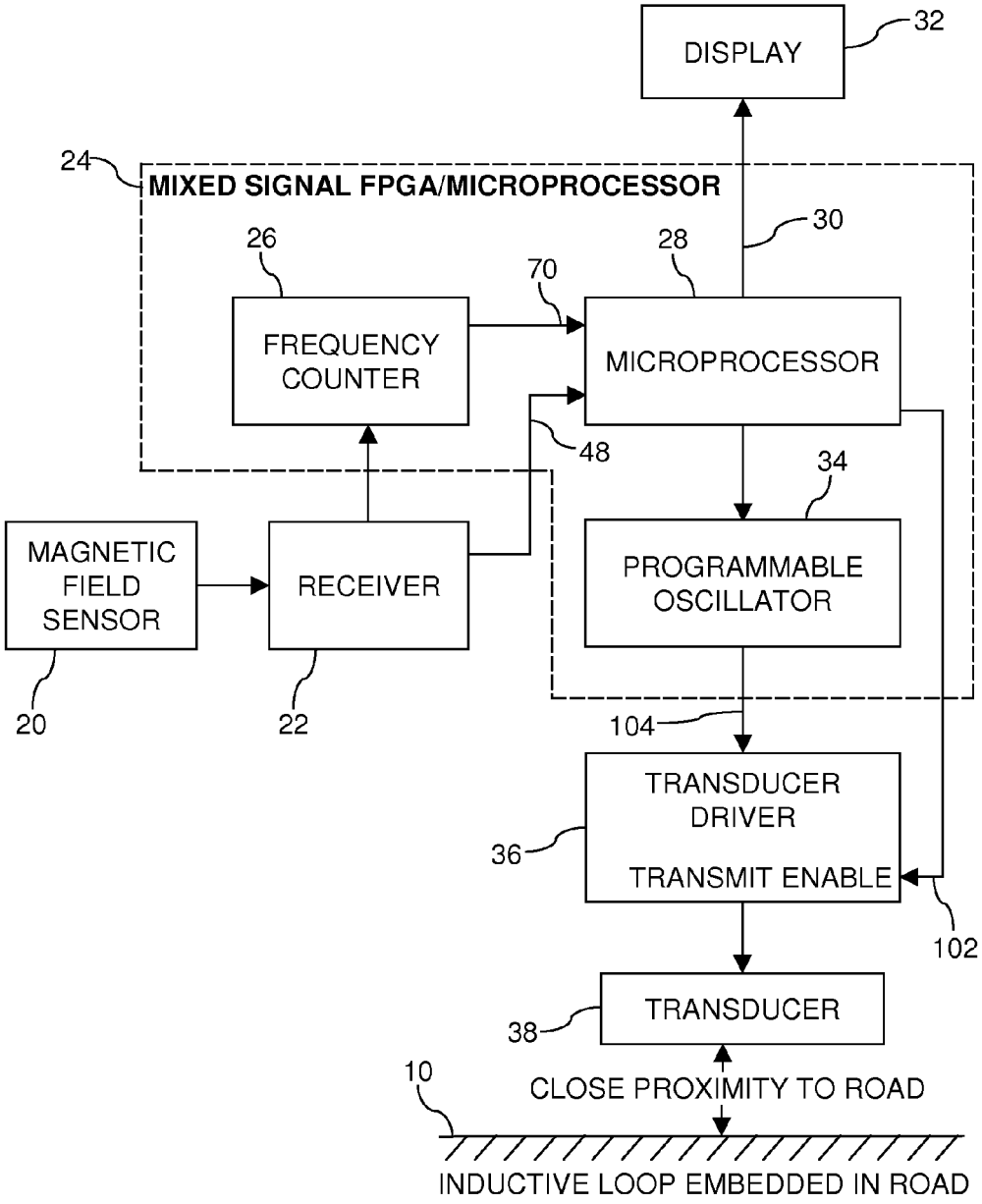
FIG. 1 shows a top level block diagram of a device in accordance with one embodiment of the invention.

One embodiment of the device is illustrated in FIG. 1. It detects the target loop detector's running frequency by direct measurement using a sensor 20, then matches the frequency with a very accurate crystal clock oscillator. It then drives a separate transducer 38—located on the vehicle as close as possible to the buried loop 10—at this detected frequency then "pulls" the loop detector by raising the frequency of the transducer's output slightly. The level of "pull" is adjusted to be optimal to match the currently achieved couple (the mutual influence the device's transducer has with the buried loop) at each loop detector. During experiments, it was noted that, during a modest "pull", within the capability of the currently achieved couple with the loop detector, the receiver 22 can detect only a single frequency as the loop detector's frequency and the device's transducer frequency are coincident.

During an excessive "pull", the receiver 22 will start to detect two frequencies as the transducer 38 of the invention starts to "pull" beyond the couple currently achieved with the buried loop 10. Once the two frequencies separate, the maximal couple has been exceeded and no further advantage is achievable by pulling to a higher frequency. In fact the pull becomes more and more ineffective as the device's output frequency rises and the loop detector's output starts to return to normal running frequency. The device is designed to stop pulling higher the moment it detects two separate frequencies. It has then achieved the best possible influence over the loop detector commensurate with the currently achieved couple, and will maintain this level of pull until the vehicle to which it is installed leaves the traffic junction.

The typical frequency change required to influence a modern loop detector is quite small. As small as 0.0025% of the free running frequency. To achieve this level of accuracy, the device has to detect and transmit to a very fine degree. The first embodiment achieves this level of accuracy by using quartz crystal-controlled frequency regulation over both the frequency counter 26 in the detector section, and the programmable oscillator 34 in the transmitter section. To keep everything synchronous in this embodiment, the frequency counter 26 and the programmable oscillator 34—as well as the controlling microprocessor 28—all run on the same clock and are all part of the same device: a field programmable gate array 24 (FPGA). By using custom-programmed logic for the frequency counter 26 and programmable oscillator 34, while still programmable from the microprocessor 28, they are designed to be free running and independent, and are not delayed or interrupted by microprocessor 28 activity, thus attaining very accurate measurements and transmissions.

DETAILED DESCRIPTION

FIGS. 2 Through 5—First Embodiment

Figure 2:
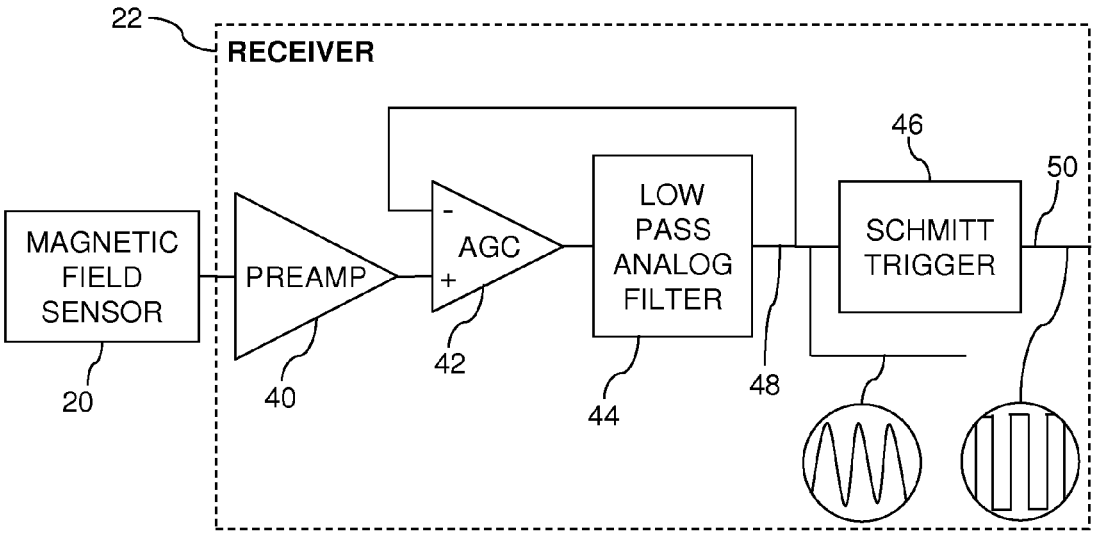
FIG. 2 shows the layout of the receiver section of the embodiment detailing signal processing in preparation for driving a frequency counter.

FIG. 2 shows the receiver 22 in more detail. The magnetic field sensor 20 feeds the receiver 22 through a pre-amplifier 40 which amplifies and buffers the signal received from the loop detector 10 that the device is in proximity to. To maintain the signal at a level useful to the following sections, an automatic gain control (AGC) amplifier 42 is used. For the prototype AGC, a J-FET biased in its ohmic region was used as a voltage controlled resistor in the gain stage of a common operational amplifier (op amp) circuit. To avoid aliasing in the subsequent digital signal processing section, an analog 5th order low-pass filter 44 is used to steeply cut off any frequency components above the region of interest—in this case above 100 kHz. For the prototype, this filter was composed of standard op amp circuitry using a standard Sallen-Key filter design. The output 48 of the filter 44 is used as feedback for the AGC 42 to keep the amplitude of the processed signal as constant and as maximal as possible without clipping the signal peaks. Accurate zero-crossing (the point at which the signal crosses through zero volts) timing is then achieved both by using an amplifier configured as a Schmitt trigger 46 and with high gain to amplify the input to a near-square wave. This greatly enhances the accuracy of zero-crossing time measurement and thus frequency measurement. Further enhancement to the level of timing accuracy is later achieved by averaging in the microprocessor 28 and a loop counter 58 described below. The unclipped filter output 48 could optionally be used as input to an analog-to-digital converter (ADC) for digital signal processing (DSP) using fast Fourier transform (FFT) frequency domain methods in a second embodiment.

Figure 3:
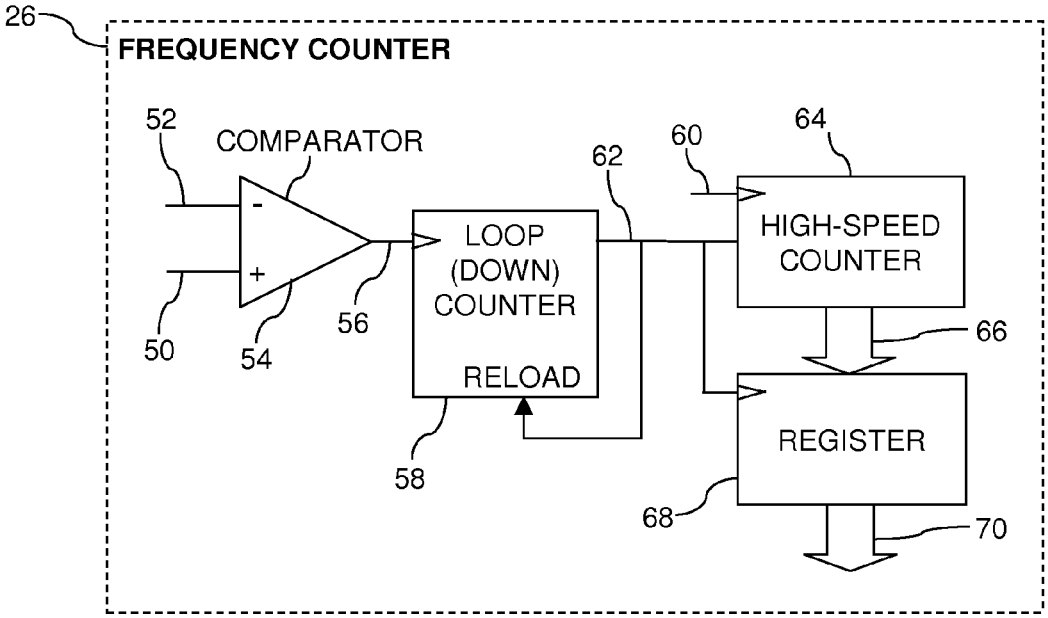
FIG. 3 shows the frequency counter of the embodiment which converts an analog square wave signal from the receiver section into a digital value representing the frequency being measured.

The output 50 of the Schmitt trigger 46 of receiver 22 is then used as input to the frequency counter 26 of FIG. 3. This frequency counter, while part of FPGA 24 that also contains microprocessor 28 and is clocked by the same crystal clock 60, runs independently of microprocessor activity. It can therefore achieve very accurate measurements since it is not adversely affected by microprocessor events and latencies. Schmitt trigger output 50 is input to an analog comparator 54. The other input 52 to comparator 54 can be programmed within the FPGA to a particular voltage to enable fine adjustments to the zero crossing point to be measured. In another embodiment, this voltage could be programmed to be dynamic should that be desired. Comparator output 56 is fed into loop counter 58 as a clock signal. Loop counter 58 is a down counter preprogrammed with a chosen number of loop cycle counts. The purpose of this counter is to multiply up the number of loop cycles to be measured for duration in order to average out any remaining zero-crossing jitter from the analog input section of receiver 22. The number used as a multiplier can be any convenient value for subsequent measurement by a high-speed counter 64. If too high a loop cycle count is used, the spacing between them may exceed that of the mark-space ratio of a multi-loop detector, and will also require a much larger high-speed counter 64 to measure the achieved period. Too small, and the averaging achieved will be inconsequential. The inventor found a value between ten and twenty to work well, choosing fourteen for prototyping. Thus the frequency counter 26 outputs the equivalent period of fourteen loop detector cycles regardless of their frequency.

The output 62 of loop counter 58 is used as input to a high-speed up-counter 64. This counter, like the loop counter, is part of FPGA 24 and is clocked with the same quartz crystal clock 60. Its purpose is to measure the much slower multiple count loop cycle period as output by the loop counter 58 in order to later calculate the loop detector's running frequency. Every time the loop counter counts down to zero, its output 62 pulses. This pulse is used to reset high-speed counter 64 and to preload the loop counter—to fourteen in the case of the prototype. At the same time, the count achieved by the high-speed counter 64 since the last loop counter pulse is clocked into a register 68 for passing to the microprocessor 28 for calculating loop detector 10 frequency. The bit width of high-speed counter 64 and register 68 are chosen to hold the largest number expected from the lowest frequency the loop detector is likely to encountered at modern intersections. Using a very conservative 5 kHz, a 16-bit wide high-speed counter 64 and register 68 were chosen for the prototype.

Figure 5:
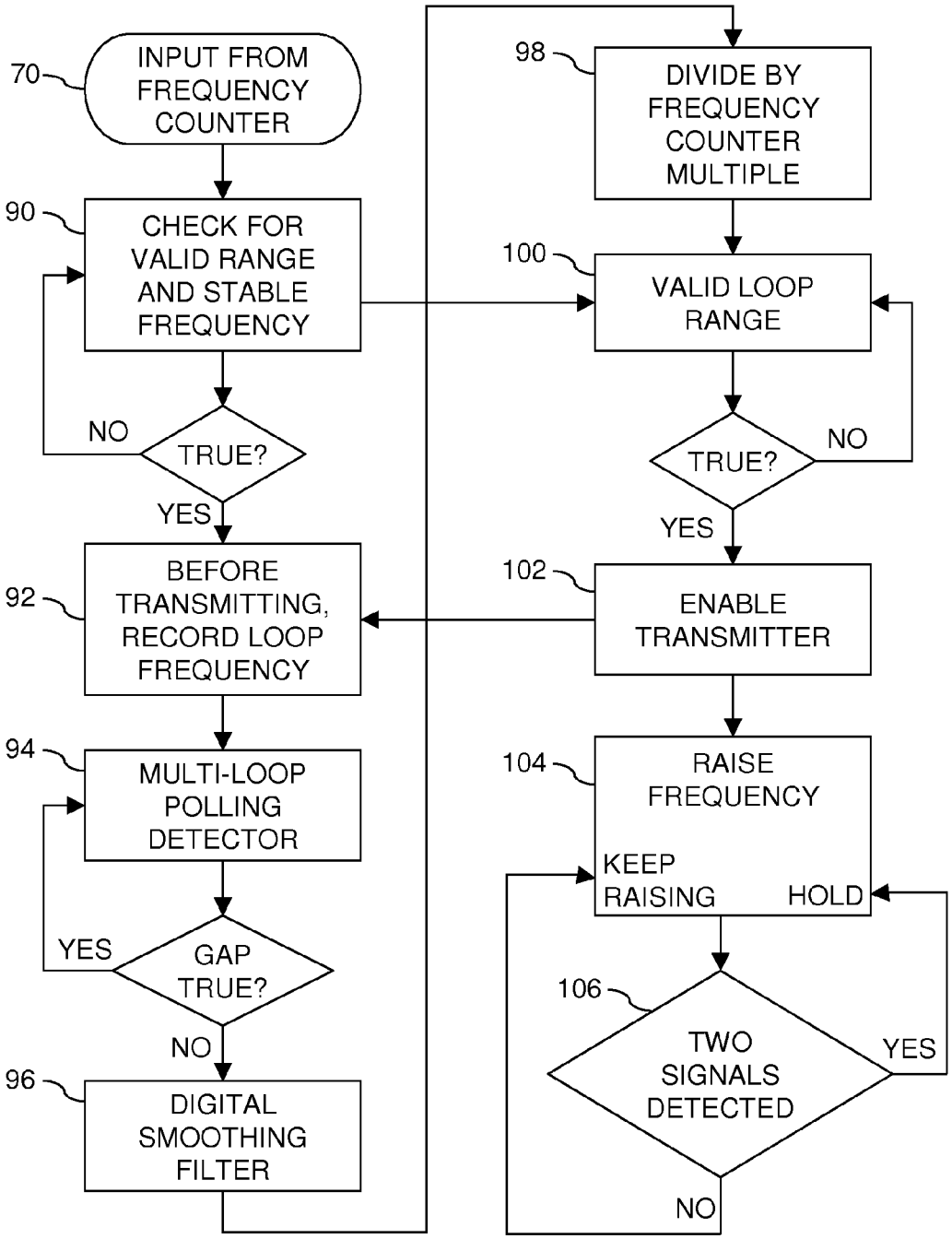
FIG. 5 shows a flowchart of the software used in the embodiment.

The output 70 of register 68, and consequently the frequency counter 26 as a whole, is passed to microprocessor 28 for digital processing. Note that, since this embodiment does not require complex software processing, any high, or even low, level software language can be used, including assembler language. For prototyping purposes, the C language was used. But to show how this can be achieved in any language, a software flowchart is used here rather than a particular single language listing. Referring to FIG. 5 which details the software flowchart for microprocessor 28, input from the frequency counter 70 is first checked for valid frequency range and stability 90 to ensure what is being received is a loop detector signal and is not random noise. This is accomplished by examining individual input values from the frequency counter 26 before any digital filtering, and comparing them to previous values. Inputs that are out of range or are obviously not related to a previous set of values are ignored.

When a valid signal is detected, provided the device is not transmitting, it is recorded 92 as the base—i.e. so far uninfluenced—level frequency of the newly-detected loop detector 10. If, from subsequent input values, the loop detector 10 is determined to be part of a multi-loop detector, this base frequency value is used for each successive "frame" (group of values between gaps in transmission) of input values 94.

Input values are then digitally smoothed with filter 96. This can be any digital filter including, but not limited to, a Kalman filter. For the prototype, a simple 1st order digital filter was used. After filter 96, the multiplier used in the frequency counter 26, which was fourteen in the case of the prototype, is removed digitally by divider 98. The result is a value that is equal to the period of the detected signal.

If the signal is still valid 100, the microprocessor 28 enables transmission 102 and then recreates a value that is the same or very slightly shorter period (higher frequency) 104 and is fed to a digital programmable oscillator 34 described below. The microprocessor 28 continues the method of incrementally increasing the frequency until a rapid increase in frequency is detected 106. This is in fact the point at which the loop detector 10 and the device's transmission frequency start to diverge into two separate frequencies and the apparent rapid increase is in fact the modulation of one signal by the other. This has been found to be the exact frequency at which maximal and optimal influence over the loop detector, by this device, is achieved. When this split is detected 106, the microprocessor 28 ceases to further increment the driven frequency at the output transducer 36 and maintains this optimal transmission to maintain the best possible vehicle presence detection at the loop detector 10.

Figure 4:
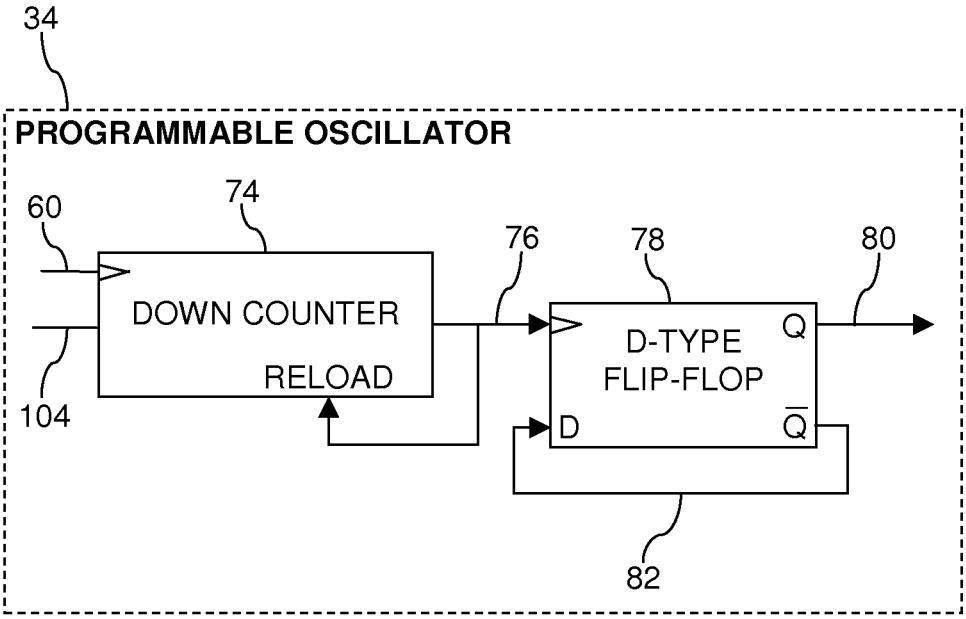
FIG. 4 shows the programmable oscillator of the embodiment which converts a digital value into an oscillating signal with which to drive an output transducer.

A digital programmable oscillator 34 is used to drive the output stage of the device. Referring to FIG. 4, the value from 104 fed to oscillator 34 is actually exactly half that of the desired period of the transmission. Oscillator 34 consists of a down counter 74 preloaded with value 104 and clocked by the high-speed quartz crystal clock. Every time the down counter 74 counts down to zero, its output 76 pulses. This pulse is used to preload down counter 74 back to value 104, and is also fed to the clock input of a simple D-type flip-flop. This flip-flop is set up to swap state at every clock by feeding back its inverse output to its input 82, thus effectively doubling the period of value 104 back to the desired transmission square wave drive signal 80. This signal 80 is used as input to transducer driver 36 (FIG. 1), which consists of an industry-standard H-bridge mosfet driver. For the prototype, an Intersil HIP4080A driving four IRFZ44 mosfets was used. Transducer driver 36 is enabled 102 by microprocessor 28. Driver 36 in turn drives the transducer 38 which is mounted on the vehicle as close as is practical to the ground and thus the buried loop detector 10 when encountered. A coil of 24 turns of wire around a ⅝"×5" ferrite rod was used as the transducer in the prototype.

Because the base level frequency of the loop detector signal is recorded before attempting to influence it, and because the subsequent level of change commensurate with the transformer couple achieved with the loop detector 10 is also known, it is possible to inform the user via a display 32 not only that a loop detector has been detected, but also the level of influence the device is currently achieving over the loop detector 10 based on the percentage difference between the original signal value and the maximum achieved. This information can be very reassuring in letting the user know that the device is registering their presence with the loop detector 10 at the junction. This display 32 can be under the direct control of microprocessor 28 and can drive any type of display or indication including, but not limited to, a light emitting diode (LED) array and/or a liquid crystal display (LCD) graphical display. An external display or data processing method, either wired or wireless, could also be realized. This could potentially be used in conjunction with a global positioning system (GPS) to build a database of troublesome loop detectors. These data could potentially be of use to local authorities for scheduling traffic light repairs or adjustments. Thus this embodiment could be of benefit to both small vehicle operators and local authorities.

For prototyping, an LED array was used to indicate loop detection and level of influence. This level-of-influence display can most usefully be based on percentage of frequency changed, since absolute numbers are of little relevance to the end user. It is possible however in another embodiment, that a more extensive display, such as a graphical LCD display, could provide the end user with such details as the base frequency of the loop detector 10, and the exact degree of influence achieved as an absolute number. This level of detail would, however, probably be more useful to a technician than an end user.

Description of a Second Embodiment

As described at the end of the first paragraph describing the detailed description of a first embodiment, a second embodiment could be realized by feeding filter output 48 to an analog-to-digital converter (ADC). Because of the "upstream" use of an automatic gain control (AGC), output 48 has a suitable and stable amplitude for feeding to an ADC where the full signal envelope can be further processed by digital signal processing (DSP). Thus the separation of frequencies at the crucial frequency could be determined by DSP methods and frequency domain analysis such as the use of Fast Fourier Transforms (FFT's) or Chirp-Z Transforms (CZT). These methods could be implemented in a layout similar to the first embodiment by including custom blocks for the ADC and FFT's in the programmable device used, thus not increasing the physical complexity of the device.

Accordingly the reader will see that, according to at least one embodiment, I have provided a method by which a device can reliably trigger an inductive loop detector at a traffic light-controlled road junction without the disadvantages of the prior art discussed. Additionally, a method of displaying the influence the device is having over a particular loop detector is also described. While the above description contains many specificities, these should not be construed as limitations on the scope of any embodiment, but as exemplifications of various embodiments thereof. Many other ramifications and variations are possible within the teachings of the embodiments. For example, a similar layout could be achieved without the use of a customizable FPGA. Discrete logic integrated circuits and a separate microprocessor could equally be used. Or, in place of 5th order low-pass filter that was built from discrete components in a common Sallen-Key design for the prototype, an off-the-shelf commercially-available 5th order filter single device could have been used. Thus the scope should be determined by the appended claims and their legal equivalents, and not by the examples given.

The invention claimed is:

1. An apparatus for tripping a traffic light inductive loop sensor, comprising:

a magnetic field sensor generating a measurement signal in response to the detection of a magnetic field from the inductive loop sensor;

a microprocessor that receives the measurement signal from the magnetic field sensor, determines the frequency of the measurement signal and generates a transmit signal having the same frequency as the measurement signal; and a transducer for receiving the transmit signal from the microprocessor and generating a magnetic field that is coupled to the inductive loop sensor, wherein the microprocessor increases the frequency of the transmit signal until the magnetic field sensor detects a point of optimum influence on the inductive loop sensor and wherein the microprocessor maintains the frequency of the transmit signal at the increased frequency when the point of optimum influence is detected.

2. The apparatus of claim 1, wherein the microprocessor is a FPGA.

3. The apparatus of claim 1, further including a display to display the point of optimum influence.

4. The apparatus of claim 1, wherein the point of optimum influence is obtained by determining that the measurement signal contains two simultaneous, different signals.

5. The apparatus of claim 4, wherein the point of optimum influence is obtained by frequency analysis.

6. The apparatus of claim 3, wherein the display is a light emitting diode array.

7. The apparatus of claim 3, wherein the display is a liquid crystal display.

8. The apparatus of claim 3, where the display is remotely located from the microprocessor and wherein the apparatus further includes a transmitter for transmitting a signal to the remote display.

9. A method of tripping a traffic light inductive loop sensor, comprising:

detecting a magnetic field from the inductive loop sensor;

determining the frequency of the magnetic field;

transmitting a magnetic field having the same frequency to couple with the inductive loop sensor;

increasing the frequency of the magnetic field until the point of optimum influence is determined; and continuing to transmit the magnetic field at the increased frequency.

10. The method of claim 9, further comprising the step of displaying when the point of optimum influence is reached.

11. The method of 9, wherein the point of optimum influence is determined when the detected magnetic field contains two simultaneous, different signals.

12. The method of claim 10, wherein the display is on a light emitting diode array.

13. The method of claim 10, wherein the display is on a liquid crystal display.

14. The method of claim 10, wherein the display is remote from the detection and the signal is transmitted to the remote display.

* * * * *